United States Patent [19]

Davis

[11] Patent Number: 4,555,035

[45] Date of Patent: Nov. 26, 1985

[54] CONTAINER CLOSURE WITH TUNNEL MEMBER

[75] Inventor: Eugene E. Davis, Ilford, England

[73] Assignee: Johnsen & Jorgensen (Plastics) Limited, England

[21] Appl. No.: 674,670

[22] Filed: Nov. 26, 1984

[51] Int. Cl.[4] ..... B65D 55/02

[52] U.S. Cl. ..... 215/215; 215/206; 215/302

[58] Field of Search ..... 215/215, 206, 302, 211, 215/295, 296, 299; 220/284

[56] References Cited

U.S. PATENT DOCUMENTS 4,355,729 10/1982 Maguire ..... 215/302

4,449,638 5/1984 Davis ..... 215/206

*Primary Examiner*—George T. Hall

*Attorney, Agent, or Firm*—Roylance, Abrams, Berdo & Goodman

[57] ABSTRACT

The present invention provides a closure for a container. The closure is provided with a tunnel member into which any appropriate implement such as the handle of a teaspoon can be inserted when it is desired to manipulate the closure e.g. for opening. The provision of the tunnel member is of great assistance to people lacking in manual dexterity.

26 Claims, 3 Drawing Figures

CONTAINER CLOSURE WITH TUNNEL MEMBER

FIELD OF THE INVENTION

This invention relates to closures for containers and more particularly though not exclusively to closures which are tamper resistant and/or child resistant.

BACKGROUND OF THE INVENTION

In recent years closures have become very effective in the sense that they are often quite difficult for small children to remove. For example, one kind of child-resistant closure has to be turned to a special vertical alignment position relative to the container and then has to be flipped off against restraint imposed by engaging arcuate beads. Such closures have a very good safety factor in the sense that it is unlikely that a small child simply playing with a closed container will, by a fluke, remove the closure. On the other hand, it has become apparent that such closures are so difficult to remove that adults who suffer from arthritis in their hands or have some other condition that restricts their manipulative capacity have great difficulty in opening the container and, in fact, there are many cases in which adults suffering with their hands have found it quite impossible to manipulate these kind of closures.

SUMMARY OF INVENTION

It is therefore a general object of the invention to provide a container closure that can readily be manipulated by someone with a hand disability and more specifically it is an object of the invention to provide a child-resistant closure that is adapted so that someone with a hand disability can relatively easily manipulate it, while at the same time retaining the child-resistant capacity of the closure and permitting easy removal without assistance by adults not handicapped by any hand disability.

According to the present invention we provide a closure with a tunnel into which an implement such as the handle of a tea spoon can be inserted when it is desired to manipulate the closure.

In order that the invention may be more clearly understood, reference is now directed to the accompanying drawings given by way of example, in which:

DETAILED DESCRIPTION OF THE PREFERRED EMBODIMENTS

Figure 1:
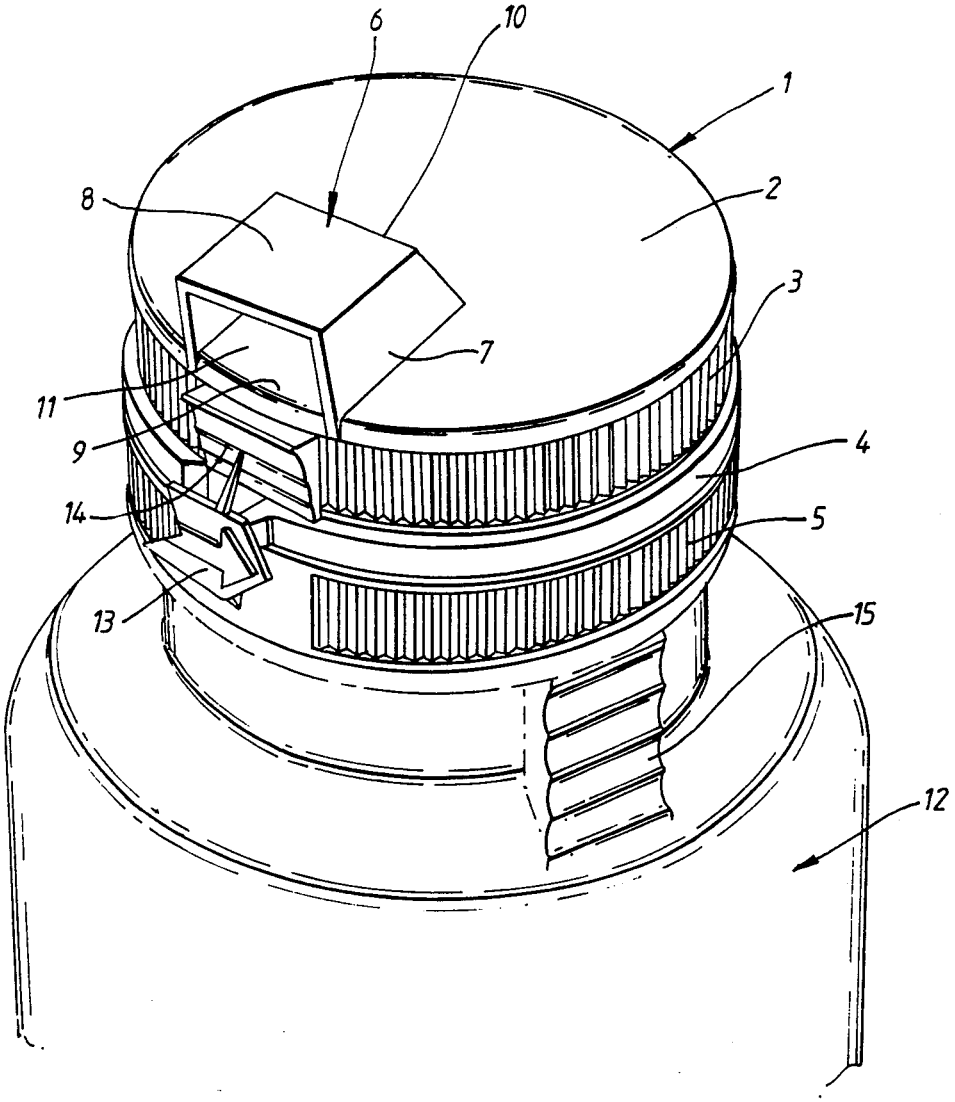
FIG. 1 is a perspective view of the first embodiment of the invention.

Referring first to FIG. 1 a closure 1 has a top 2, a depending skirt 3, a tear away band 4 and an anchor band 5. The top 2 of the closure 1 is provided with a tunnel member 6 defined by side walls 7, a top wall 8, a bottom wall 9 and a rear wall 10, the tunnel member 6 being open at the front 11. Clearly if desired the rear wall 10 can be omitted from this embodiment.

To remove the closure 1 from the container 12 it is necessary first to remove or tear away the tear band 4 which can be effected relatively easily by gripping a tear tab indicated at 13. This has to be done only once and, if a user cannot effect the tearing movement, assistance can be obtained to remove the tamper-resistant feature. This movement leaves the child-resistant feature intact and to remove the closure 1 from the container 12 it is still necessary to turn the closure 1 until the tunnel 6 is in vertical alignment, with a mark or indicator 15 on container 12 and then to push up on tunnel 6 opening 11 or a push tab 14. To assist a user with a hand disability to do this an appropriate instrument may be inserted into or through the tunnel member 6 for use in the manner of a tommy-bar, lever or handle.

It will be understood that the precise shape and/or disposition of the tunnel member 6 is immaterial. In FIG. 1, for example, we show the tunnel member 6 standing proud of the top 2 of the closure 1 so that it can form a grip for unhandicapped people to use when turning the closure 1. However, the tunnel member may if desired be inserted flush into the closure 1 below top 2 with the open end 11 being provided in the skirt 3, or the opening 11 may be in the top 2 of the closure 1 with the tunnel member extending vertically or at an angle down into the inside of the closure. The underlying idea of the invention is therefore to provide a closure with a tunnel member into which an implement may be inserted to give a user a mechanical advantage in manipulating the closure.

It should be emphasised that a special implement is not required; the handle of a tea spoon, the blade of a paper knife, a pair of scissors or a door key are good examples of the kind of implement that is readily to hand and may be used.

In a slight modification, the tunnel member 6 may be dimensioned to overlap the outer edge of the top 2 so as to supplement or replace the push tab 14.

Further details of this type of closure, apart from the tunnel feature, may be obtained from UK patent application No. 8405427 and from European patent application No. 8235409.

Figure 2:
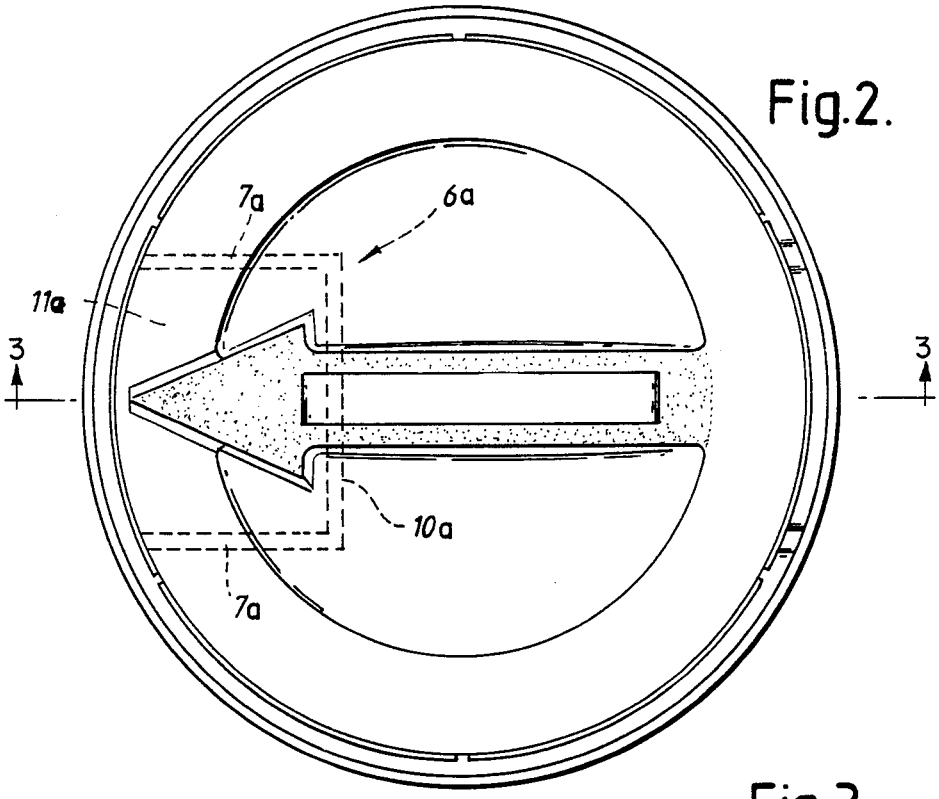
FIG. 2 is a top plan view of a second embodiment of the invention.
Figure 3:
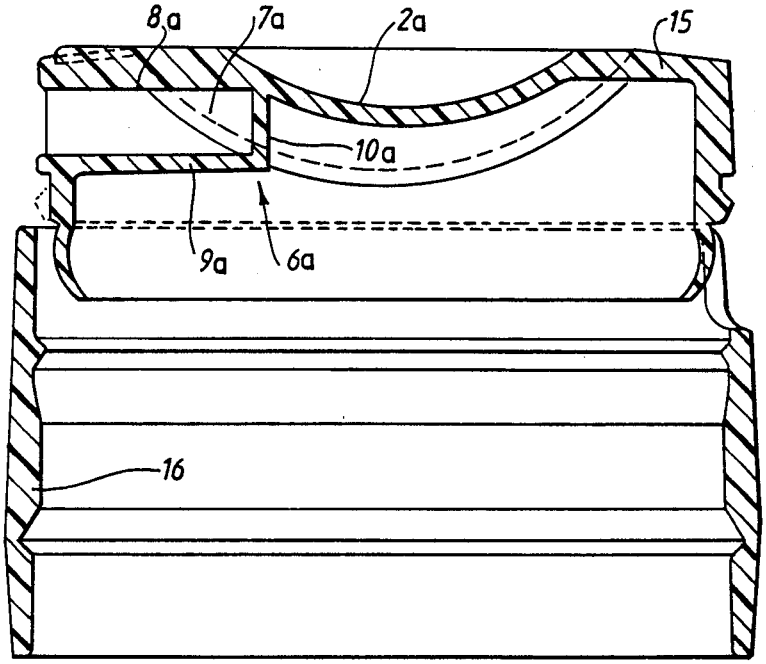
FIG. 3 is a cross-sectional view taken on line 3—3 of FIG. 2.

Passing on now to consider the second embodiment of FIGS. 2 and 3, details of the type of closure concerned may be obtained from UK Pat. No. 1583984 and European patent application No. 81300309, the teachings of which are hereby incorporated by reference as if here set forth in full. In FIGS. 2 and 3, parts the same as or similar to parts described above are indicated by the same reference number followed by "a". The closure 1*a* has an inner plug member 15 and a coaxially arranged outer sleeve member 16. The plug member 15 has a top 2*a* and when the complete closure 1*a* is in operative position the plug member 15 is seated in or over the mouth of an associated container so as to close the mouth and the skirt of the sleeve member embraces the outer surface of the container.

In accordance with this invention the plug part 15 of the closure 1 is provided with a tunnel member 6*a* defined by side walls 7*a*, a top wall 8*a*, a bottom wall 9*a* and a rear wall 10*a*, the front being open at 11*a* to receive the implement. Once again the precise shape and disposition of the tunnel member is immaterial and if desired the tunnel member could stand proud of the top 2 as in FIG. 1 or could have the opening 11*a* in the top 2 with the tunnel extending vertically or at an angle downwardly.

The closure is preferably moulded from a suitable plastics material.

We have therefore provided a container closure wherein the closure has an open tunnel member i.e.

open at both ends or with a closed tunnel member in the form of a pocket i.e. closed at the inner or rear end so that a suitable implement ready to hand may be inserted into the tunnel member to facilitate manipulation of the closure by persons suffering from Arthritis or other restricted manipulative capacity without interference with its prime function of being a child-resistant closure which can be readily opened by adults without manipulative disability.

While the invention has been described in detail above, it is to be understood that this detailed description is by way of example only, and the protection granted is to be limited only within the spirit of the invention and the scope of the following claims.

I claim:

1. A child-resistant closure for a container which, when in operative position, closes the mouth of the container and which is adapted to be removed from said container to open said mouth without mutilation of said closure by turning said closure relatively to said container into a predetermined position from which said closure may be removed upwardly, said closure being adapted to repeatedly and resealably open and close said mouth of said container, said closure including tunnel means defined by side walls, a top wall and a bottom wall all extending substantially horizontally across said closure, and said tunnel means side, top and bottom walls defining an opening for insertion of ordinary household objects such as the handle of a spoon, a key or the like to aid in manipulating said closure while at the same time not interfering with the use of said closure without the use of any such inserted household object at the option of the user.

2. The closure of claim 1, and said tunnel means opening defined by said side, top and bottom walls being relatively long in horizontal planes and relatively thin in vertical planes and having relatively sharp internal corners all to cooperate well with a said inserted household object to manipulate said closure.

3. A closure according to claim 1, wherein said means to removably secure said closure to said container includes tamper-resistant and/or child-resistant closure securing means.

4. A closure according to claim 1, wherein said tunnel means are formed at the top of said closure.

5. A closure according to claim 4, wherein said tunnel means opening is positioned at the front of said tunnel means for insertion of said ordinary household objects.

6. A closure according to claim 1, wherein said means to removably secure said closure include means making it necessary to rotate said closure to an operative position wherein said tunnel means are aligned with a cooperating mark on the container, and said means to removably secure further permitting said closure to be removed from said container only when said mark and said tunnel means are aligned.

7. A closure according to claim 4, wherein said tunnel means extends downwardly from the top of said closure, and wherein said tunnel means opening is located to be flush with said top of said closure.

8. A closure according to claim 1, said closure including a skirt, and said tunnel means opening being formed in said closure skirt.

9. A closure for a container, means to removable secure said closure to said container, said closure comprising tunnel means formed at the top of said closure, said tunnel means extending upwardly of the top of said closure, whereby said tunnel means may also function as means to grip said closure, and said tunnel means having an opening for insertion of ordinary household objects such as the handle of a spoon, a key or the like to aid in manipulating said closure while at the same time not interfering with use of said closure without the use of any such inserted household object at the option of the user.

10. A closure according to claim 1, wherein said closure comprises an inner plug member and a coaxially arranged outer sleeve member, and said tunnel means being provided on said inner plug member.

11. A closure accordng to claim 9, wherein said means to removably secure said closure to said container includes tamper-resistant and/or child-resistant closure securing means.

12. A closure according to claim 9, wherein said tunnel means are defined by side walls, a top wall interconnecting said side walls, a bottom wall interconnecting said side walls, and said tunnel means opening being positioned at the front of said tunnel means for insertion of said ordinary household objects.

13. A closure according to claim 9, wherein said means to removably secure said closure includes means making it necessary to rotate said closure to an operative position wherein said tunnel means are aligned with a cooperating mark on the container, and said means to removably secure further permitting said closure to be removed from said container only when said mark and said tunnel means are aligned.

14. A closure according to claim 9, said closure including a skirt, and said tunnel means opening being formed in said closure skirt.

15. A closure according to claim 9, wherein said closure comprises an inner plug member and a coaxially arranged outer sleeve member, and said tunnel means being provided on said inner plug member.

16. A closure for a container, means to removable secure said closure to said container, said closure comprising tunnel means formed therein, said tunnel means being dimensioned so as to overlap an outer edge of the top of said closure to thereby provide a push tab, and said tunnel means having an opening for insertion or ordinary household objects such as the handle of a spoon, a key or the like to aid in manipulating said closure while at the same time not interfering with use of said closure without the use of any such inserted household object at the option of the user.

17. A closure according to claim 16, wherein said means to removably secure said closure to said container includes tamper-resistant and/or child-resistant closure securing means.

18. A closure according to claim 16, wherein said tunnel means are formed at the top of said closure.

19. A closure according to claim 18, wherein said tunnel means are defined by side walls, a top wall interconnecting said side walls, a bottom wall interconnecting said side walls, and said tunnel means opening being positioned at the front of said tunnel means for insertion of said ordinary household objects.

20. A closure according to claim 16, wherein said means to removably secure said closure include means making it necessary to rotate said closure to an operative position wherein said tunnel means are aligned with a cooperating mark on the container, and said means to removably secure further permitting said closure to be removed from said container only when said mark and said tunnel means are aligned.

21. A closure according to claim 18, wherein said tunnel means extend upwardly of the top of the closure, whereby said tunnel means also function as means to grip said closure.

22. A closure according to claim 18, wherein said tunnel means extends downwardly from the top of said closure, and wherein said tunnel means opening is located to be flush with said top of said closure.

23. A closure according to claim 16, said closure including a skirt, and said tunnel means opening being formed in said closure skirt.

24. A closure according to claim 16, wherein said closure comprises an inner plug member and a coaxially arranged outer sleeve member, and said tunnel means being provided on said inner plug member.

25. The closure of claim 9 and said tunnel means opening defined by said side, top and bottom walls being relatively long in horizontal planes and relatively thin in vertical planes and having relatively sharp internal corners all to cooperate well with an inserted household object to manipulate said closure.

26. The closure of claim 16 and said tunnel means opening defined by said side, top and bottom walls being relatively long in horizontal planes and relatively thin in vertical planes and having relatively sharp internal corners all to cooperate well with an inserted household object to manipulate said closure.

* * * * *